US010604401B2

(12) United States Patent
Nini

(10) Patent No.: US 10,604,401 B2
(45) Date of Patent: Mar. 31, 2020

(54) TAP MADE OF PLASTIC MATERIAL FOR DELIVERING LIQUIDS FROM VESSELS

(71) Applicant: Vitop Moulding S.R.L., Alessandria (IT)

(72) Inventor: Diego Nini, Alessandria (IT)

(73) Assignee: Vitop Moulding S.R.L., Alessandria (IT)

( * ) Notice: Subject to any disclaimer, the term of this patent is extended or adjusted under 35 U.S.C. 154(b) by 0 days.

(21) Appl. No.: 16/466,548

(22) PCT Filed: Nov. 13, 2017

(86) PCT No.: PCT/IT2017/000250
§ 371 (c)(1),
(2) Date: Jun. 4, 2019

(87) PCT Pub. No.: WO2018/104973
PCT Pub. Date: Jun. 14, 2018

(65) Prior Publication Data

US 2019/0337792 A1 Nov. 7, 2019

(30) Foreign Application Priority Data

Dec. 6, 2016 (IT) ..... 102016123495

(51) Int. Cl.
*B67D 3/04* (2006.01)
*B67D 1/00* (2006.01)

(52) U.S. Cl.
CPC ..... *B67D 3/045* (2013.01); *B67D 3/043* (2013.01); *B67D 2001/0089* (2013.01)

(58) Field of Classification Search
CPC . B67D 3/045; B67D 3/043; B67D 2001/0089
USPC ..... 222/511
See application file for complete search history.

(56) References Cited

U.S. PATENT DOCUMENTS 1,711,537 A * 5/1929 Lewis ..... B67D 1/0456 222/91
2,685,978 A * 8/1954 Crockett ..... B67D 1/0456 222/511
2,686,081 A * 8/1954 Cooksley ..... A62C 13/003 239/337
3,595,445 A * 7/1971 Buford ..... B65D 47/2025 222/213
3,863,673 A * 2/1975 Sitton ..... B67C 9/00 137/614.11

(Continued)

*Primary Examiner* — Patrick M. Buechner
*Assistant Examiner* — Michael J. Melaragno
(74) *Attorney, Agent, or Firm* — Young Basile Hanlon & MacFarlane, P.C.

(57) ABSTRACT

A tap is described, for delivering liquids from a vessel comprising: an elongated supporting body equipped with an inclined internal contact surface next to its delivery end; an upper closing element and tamper-preventing seal which closes the delivery end of the supporting body; a pin centrally placed inside the supporting body and equipped with an O-ring adapted to sealingly engage the inclined internal contact surface when the tap is closed; a dome-shaped elastic valve element operatively connected to the pin at the opposite end with respect to the delivery end of the supporting body, the dome-shaped elastic valve element performing the automatic closure of the tap; and a plate operatively connected to the dome-shaped elastic valve element.

9 Claims, 15 Drawing Sheets

(56) References Cited

U.S. PATENT DOCUMENTS 5,901,761 A * 5/1999 Rutter ..... F16L 37/32 137/614.04
6,644,367 B1 * 11/2003 Savage ..... B65D 77/067 137/614.04
6,892,760 B2 * 5/2005 Roos ..... B67D 1/0835 137/614.03
7,726,525 B2 * 6/2010 Nini ..... B67D 3/044 222/511
8,113,239 B2 * 2/2012 Richards ..... B67D 3/044 137/587
8,402,999 B2 * 3/2013 Nini ..... B67D 3/044 137/588
8,464,917 B2 * 6/2013 Nini ..... B67D 3/0045 222/481.5
9,604,836 B2 * 3/2017 Nini ..... B67D 3/043
9,862,533 B2 * 1/2018 Stever ..... B67D 3/043
10,301,096 B2 * 5/2019 Stever ..... B67D 3/043
10,508,015 B2 * 12/2019 Nini ..... B67D 3/043
2007/0290010 A1 * 12/2007 Nini ..... B67D 3/044 222/511
2008/0078970 A1 * 4/2008 Craft ..... B67D 3/045 251/144
2008/0237276 A1 * 10/2008 Lester ..... B67D 3/043 222/518
2008/0245816 A1 * 10/2008 Armstrong ..... B67B 7/24 222/81
2012/0199615 A1 * 8/2012 O'Keefe, Jr. ..... B67D 3/043 222/505
2014/0131397 A1 * 5/2014 Nini ..... B67D 1/0835 222/505
2015/0096999 A1 * 4/2015 Nini ..... B67D 3/043 222/81
2015/0344288 A1 * 12/2015 Ortega Collado ..... B67D 3/043 222/153.03
2016/0362239 A1 * 12/2016 Johnson ..... B65D 47/2018
2017/0107094 A1 * 4/2017 Van Der Molen ..... B67D 3/045
2017/0113912 A1 * 4/2017 Johnson ..... B67D 7/0294
2017/0190562 A1 * 7/2017 Trettin ..... B67D 3/045
2017/0247239 A1 * 8/2017 Nini ..... B67D 3/044
2018/0111816 A1 * 4/2018 Stever ..... B67B 7/26
2018/0155178 A1 * 6/2018 Nini ..... B67D 3/04
2018/0273371 A1 * 9/2018 Nini ..... B67D 3/0083
2018/0319651 A1 * 11/2018 Nini ..... B67D 3/042
2019/0256341 A1 * 8/2019 Stever ..... B65D 77/067
2020/0031658 * 1/2020 Schmidt ..... B67D 3/045

* cited by examiner

TAP MADE OF PLASTIC MATERIAL FOR DELIVERING LIQUIDS FROM VESSELS

CROSS-REFERENCE TO RELATED APPLICATION

This application claims priority to Italian Patent Application Serial No. 102016000123495, filed on Dec. 6, 2016, incorporated herein by reference in its entirety.

TECHNICAL FIELD

The present invention refers to a delivering tap of liquids from vessels, in particular the so-called vessels of the "bag-in-box" type (herein below called BIB).

Purpose of the present invention is creating a tap which is completely made of plastic material (then easily recycled) and which is adapted to connectors present on the market, actually replacing an old tap version currently marketed by company Maierhöfer.

BACKGROUND

The tap configuration produced by the above company is known in the art and is the major reference of this product.

This version, in particular the one for the adapter of connectors of company CMB, has an operating/actuating process of this type (for the version with quick connection with balls):

step 1: providing a connector present on the market;

step 2: inserting the connector on the main body of the tap;

step 3: providing the internal peg of the connector which performs the operating seal on the tap turret, on which a sealing a O-ring is assembled;

step 4: the tip of the internal peg centrally pushes an actuator of the tap, which frees the liquid outlet hole of the tap present on the body; the actuator moves by a pre-set amount, till it is blocked on a plane geometry of the body and, from then on, the central actuator operates as fixed abutment to open the center of the connector peg, to free the passage of the connector, creating an open channel connector/tap;

step 5: behind the central actuator of the tap, a metallic spring (or the same actuator will be shaped as an elastic dome, also supported by a metallic spring therein) is assembled, which allows its automatic closure (following the above described reverse cycle), allowing to take back the two systems with connector and tap in their closing position.

Such taps however have some defects.

For example, some are not completely made of plastic material, but use metallic springs therein (as occurs for the Maierhöfer tap) so that, once having disconnected it from the connector, it goes back to its closing position, avoiding liquid leakages.

The presence of a metallic spring in a set of plastic pieces makes the tap ecologically not interesting in terms of recycling.

Such taps, further, has not a real and actual warranty seal (of the tamper-preventing type), capable of pointing out a counterfeit or a simple opening thereof, but are only equipped with a small "dust-preventing" plug, whose purpose is protecting the tip of the tap from dust or dirt. Such system, present on all taps being manufactured (both the above mentioned major tap, and also the several copies of this tap), currently does not guarantee against tampering with the product contained in the BIB, since the small plug can be easily removed and re-inserted without the end user getting aware of it.

Sometimes, due to the need of providing a completely aseptic tap (and due to resistance to aseptic treatments), the welding of an operculum, preferably made of aluminum, but also of other materials adapted for such purpose (not shown in the drawings but being part of the invention) is required on the tip of the tap, in order to seal and protect the connection area during the sterilization cycles of the taps/bags.

In this case, it will not be necessary any more to place the above described tamper-preventing seal, but there remains in any case the very big advantage of an end user to understand whether the tap has been used/tampered with, since the aluminum operculum will be stably welded to the tap body.

Once removed, evidence of the opening will appear, since it will not be possible any more to stably place again the seal onto the tap.

Document WO-A1-01/98158 discloses a tap according to the preamble of claim 1.

SUMMARY

Object of the present invention is making a simple and ecologically acceptable tap, which however allows being adapted to the connectors present on the marked, not requiring their modification and changing the actuating system, making it unique and universal for all marketed connectors (as can be better seen in FIG. 6). Known connectors of company CMB present on the market are currently as many as the beverage to be delivered (the external geometry and the type of connection change depending on the beverage manufacturer), and therefore the tap of the invention will have to be able (by changing its external geometry) to be adapted without problems to all versions of CMB connectors or the like present on the market.

Herein below, one of the arrangements of CMB connectors present on the market will be shown (in FIG. 6), more specifically the one with quick connection with balls of the Jolly type for a Pepsico product.

The connector in FIG. 8 will have to be fastened, by means of a fastening ring 16 present on the main body of the inventive tap and a "ball" system 15 present on the CMB connector 8 (typical bayonet-type fastening) and perform a sealing on the internal walls of the new tap of the invention.

Simultaneously, by means of the thrust of the connector itself, an internal pin 12, which will "descend" during its fastening on the tap interior, will have to open the inventive tap, which however, in turn, will have to open the liquid passage of the connector 8, creating an open channel for the passage of liquid. Everything will be better explained below, where the differences and the advantages between the new tap of the invention and the old tap marketed by company Maierhöfer (not shown) will be better appreciated.

A further object of the invention is providing an improved delivering tap which is made with a minimum number of parts, both equipped with an internal thrusting membrane, which is the main member of the tap, which allows performing automatic closing and opening operations of the tap without using metallic springs, and a better oxygen seal, also due to the high-seal elastomeric material of which it is made and preventing/decreasing the liquid oxidation inside, since the tap of the invention, with respect to those present on the market, strongly decreases the amount of air inserted in the BIB due to its special geometries.

A further object of the present invention is providing a tap as described above, which performs an efficient sealing of the valve on the body, thereby obtaining a great increase of the oxygen barrier. Moreover, it will provide a strong decrease of the amount of oxygen which will enter the bag once having finished to fill it up, since all system members are housed on the tap back with respect to the delivery area, thereby occupying the volume which is usually free and therefore full of air like in the traditional tap.

A further object of the present invention is providing a tap as mentioned above which is equipped with a warranty seal of the tamper-preventing type, which irreversibly points out its opening or, if the application needs particular aseptic or sterilization treatments, equipped with an aluminium operculum (not shown in the drawings) welded onto the body to protect it and to point out its opening (in this case, it will not be necessary any more to place also the tamper-preventing seal on the tap).

The tap of the invention, being equipped with a high oxygen barrier, is suitable for aseptic applications.

The above and other objects and advantages of the invention, as will result from the following description, are obtained with a delivering tap as claimed in claim 1. Preferred embodiments and non-trivial variations of the present invention are the subject matter of the dependent claims.

It is intended that all enclosed claims are an integral part of the present description.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF THE EMBODIMENTS

Figure 1:
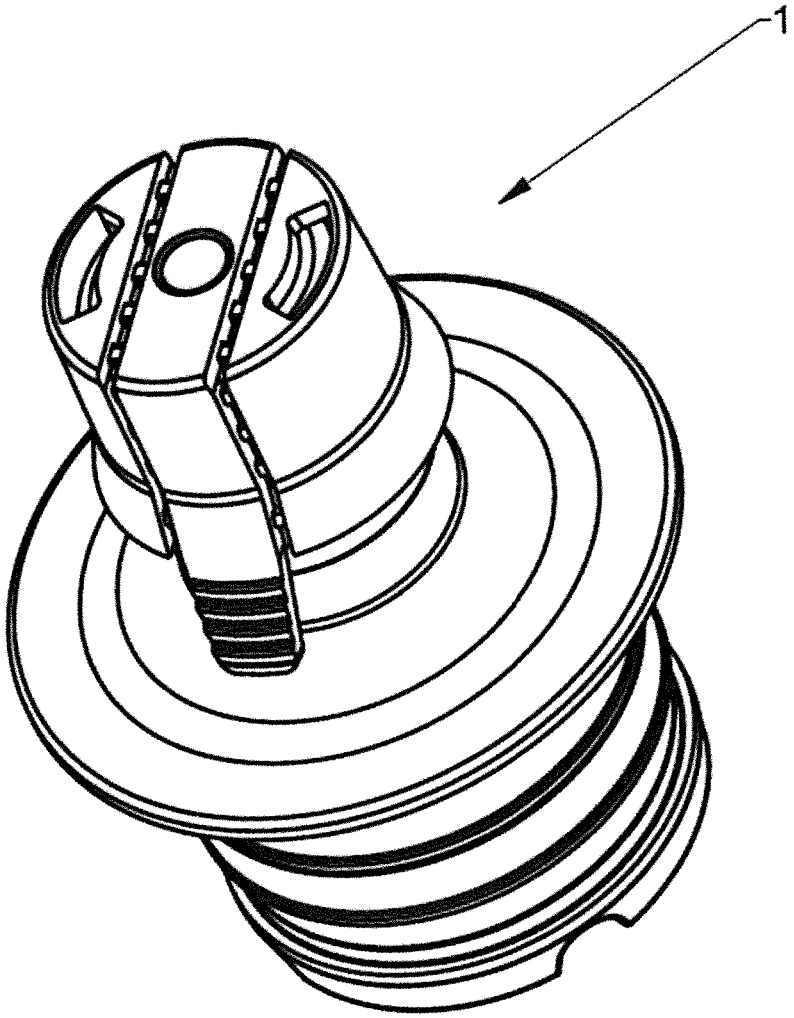
FIG. 1 is a perspective view of an embodiment of the tap according to the present invention.
Figure 2:
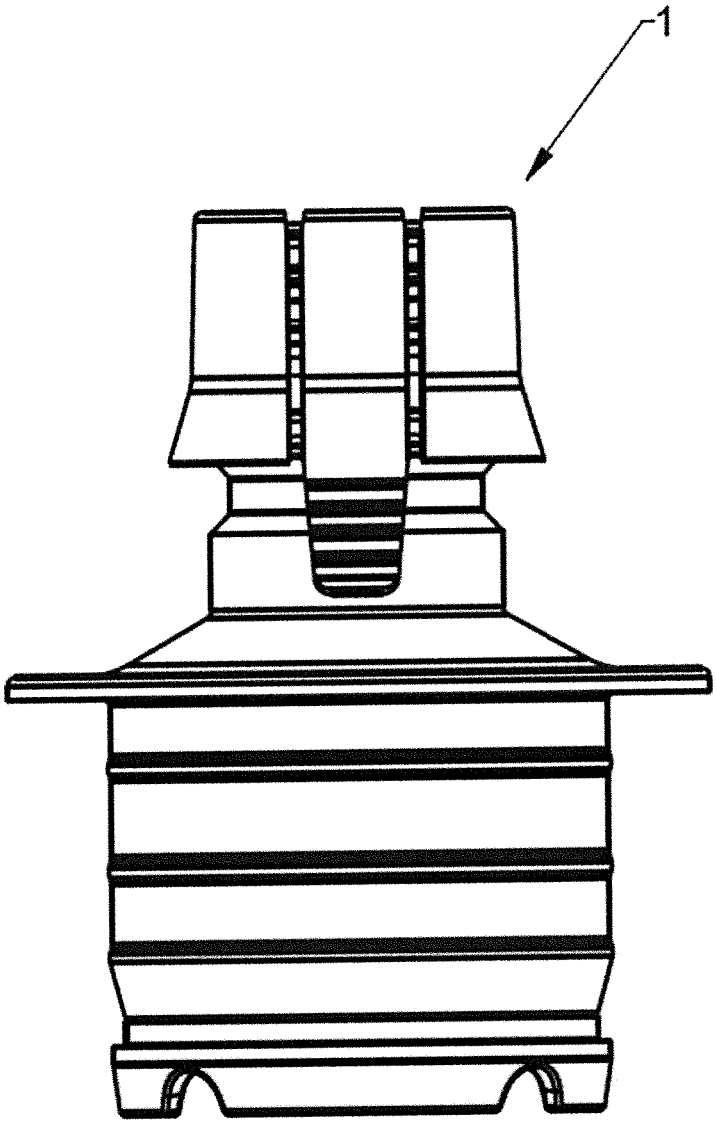
FIG. 2 is a side view of an embodiment of the tap according to the present invention.

With reference to the Figures, a preferred embodiment of the delivering tap 1 of the invention is shown and described as a non-limiting example. It will be clear from a skilled person in the art that the described tap 1 can be made with equivalent shapes, sizes and parts, and will be capable of being used for various types of vessels, for example the so-called "Bag-in-Box" ones, but also vessels or the rigid or semi-rigid types, or others.

The tap 1 of the invention is used for delivering liquids from a vessel (not shown), and substantially comprises an elongated supporting body 2, preferably cylindrical, equipped at its liquid delivering end 0A, with means 2.7, preferably shaped as a ring, for fitting and liquid sealing, and at its opposite end 0B, with means 2.6, preferably shapes as a ring, for connecting and sealing to the mouth (for BIB systems) and for preventing the removal from the vessel, by means of a connecting mouth (not shown) welded on the bag (in case of BIB). In the front area 0A there is a cylindrical extension 2.9, on which fitting geometries 2.8 are obtained, depending on marketed CMB connectors 8.

Figure 8:
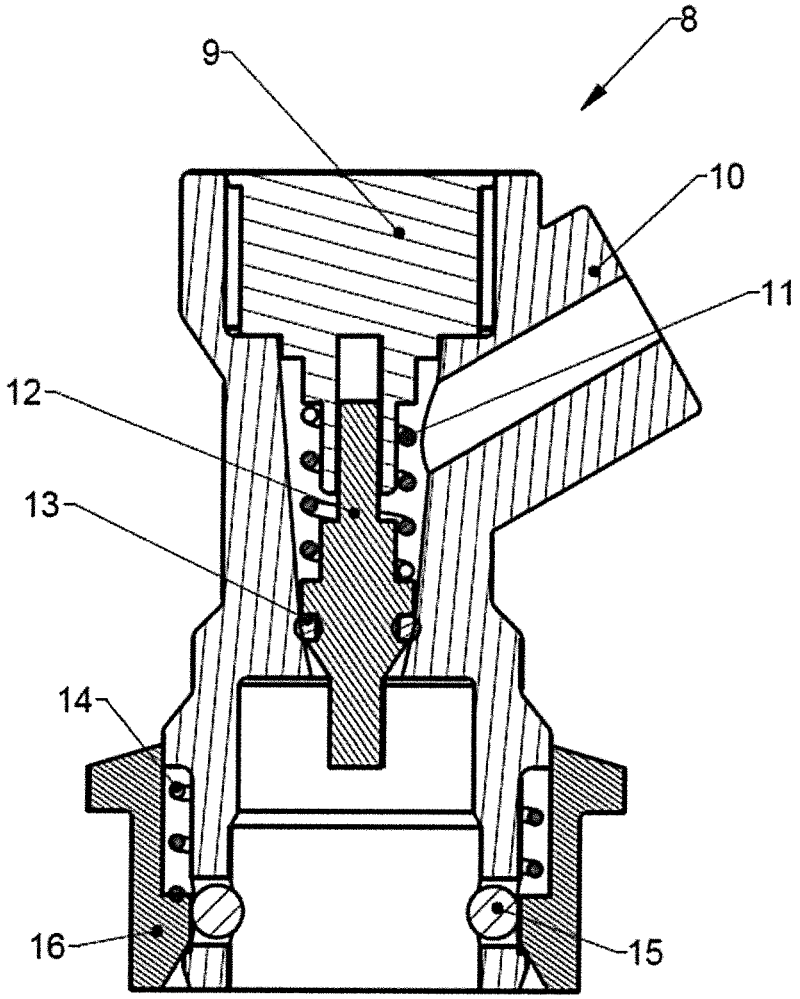
FIG. 8 is a sectional view of a connector present on the market to which one must adapt.

In the present invention, the typical CMB connection 8 of the Jolly type for Pepsico with ball-type fastening 15 will be analyzed. Such connector 8 is composed, as can be seen in FIG. 8, of a main body 10 inside which the devices which allow automatically opening and closing the connector 8 are operatively placed, and especially pin 12 on which the O-ring 13 is assembled. Behind the pin 12, the metallic spring 12 and the closing plug 9 are placed. On the lower part pieces are placed (quick, ball-type fastening of the connector 8) which operate to block the connector 8 on the geometries of the tap 1 present on the body 2, which will be described below: especially, the sealing ring 16 and the spring for automatically closing and blocking the balls 15, more precisely the metallic spring 14. The supporting body 2 is equipped with at least one first opening 2.10 for exiting the liquid. It is equipped with an external geometry 2.8 adapted to be connected to the connector 8 by means of the balls 15 and the ring for blocking the balls of the connector 16.

Figure 11:
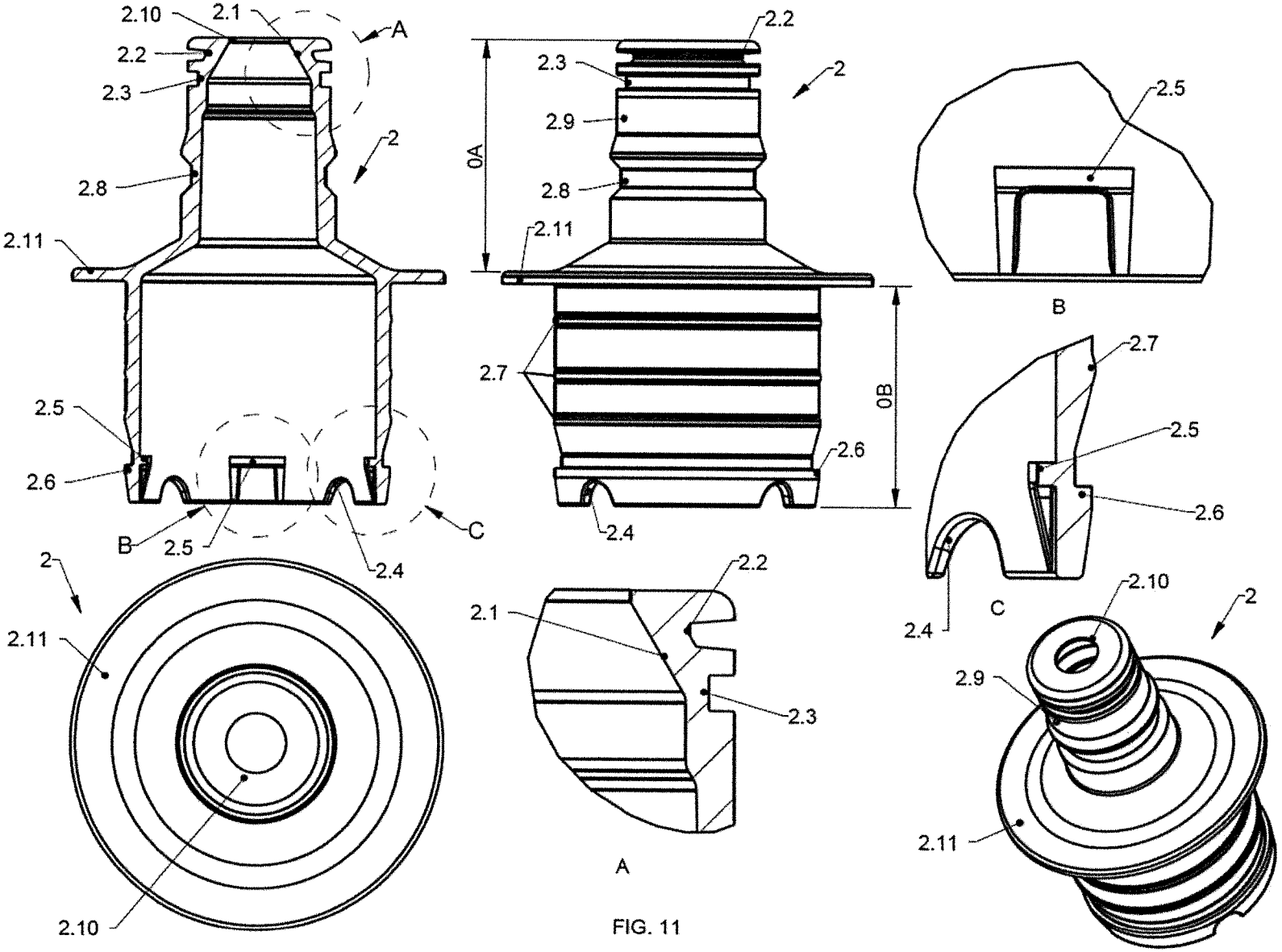
FIG. 11 is one of the views of the main body of the tap of the invention in different positions and with different details.
Figure 12:
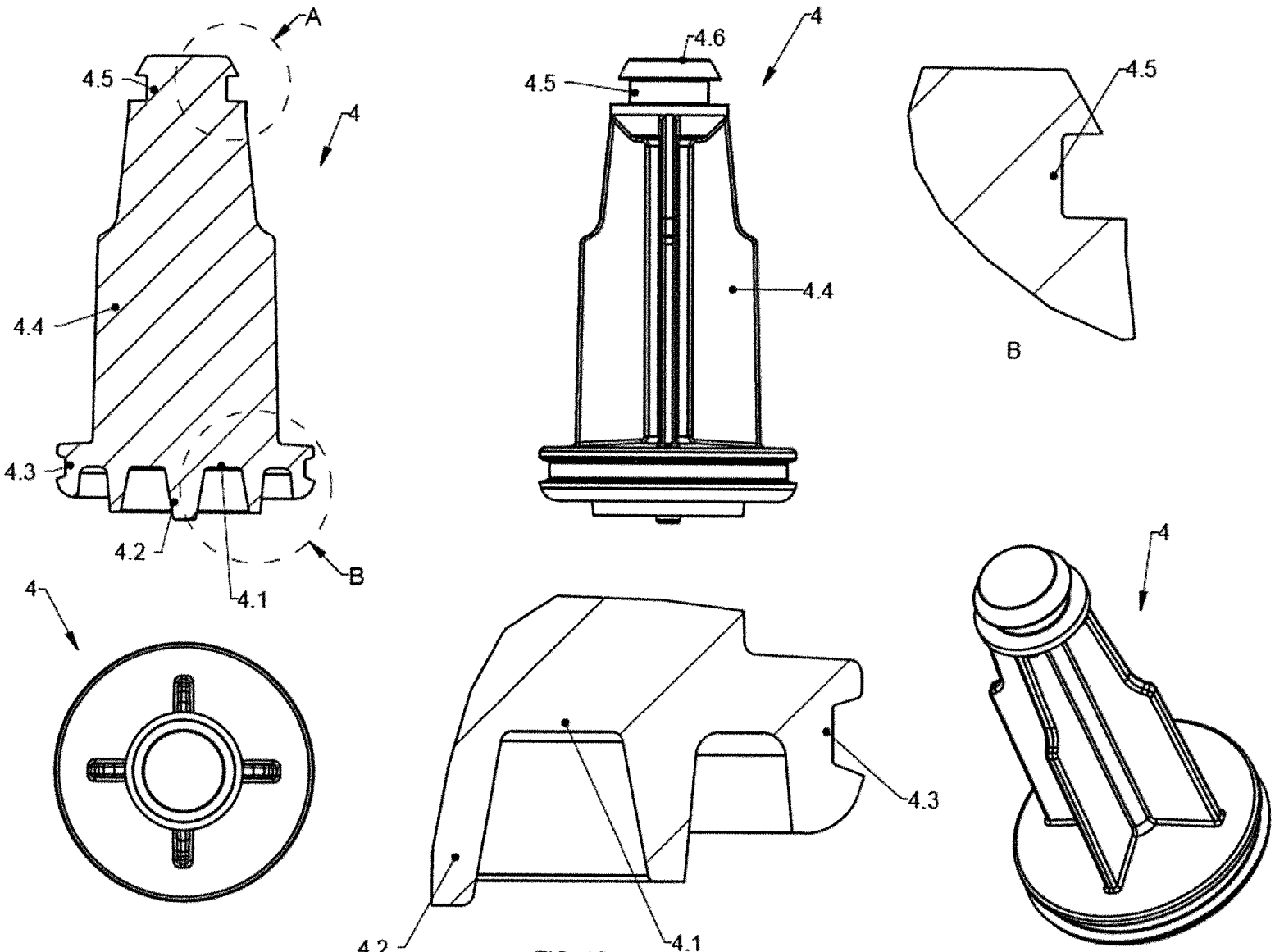
FIG. 12 is one of the views of the central pin of the tap of the invention in different positions and with different details.
Figure 13:
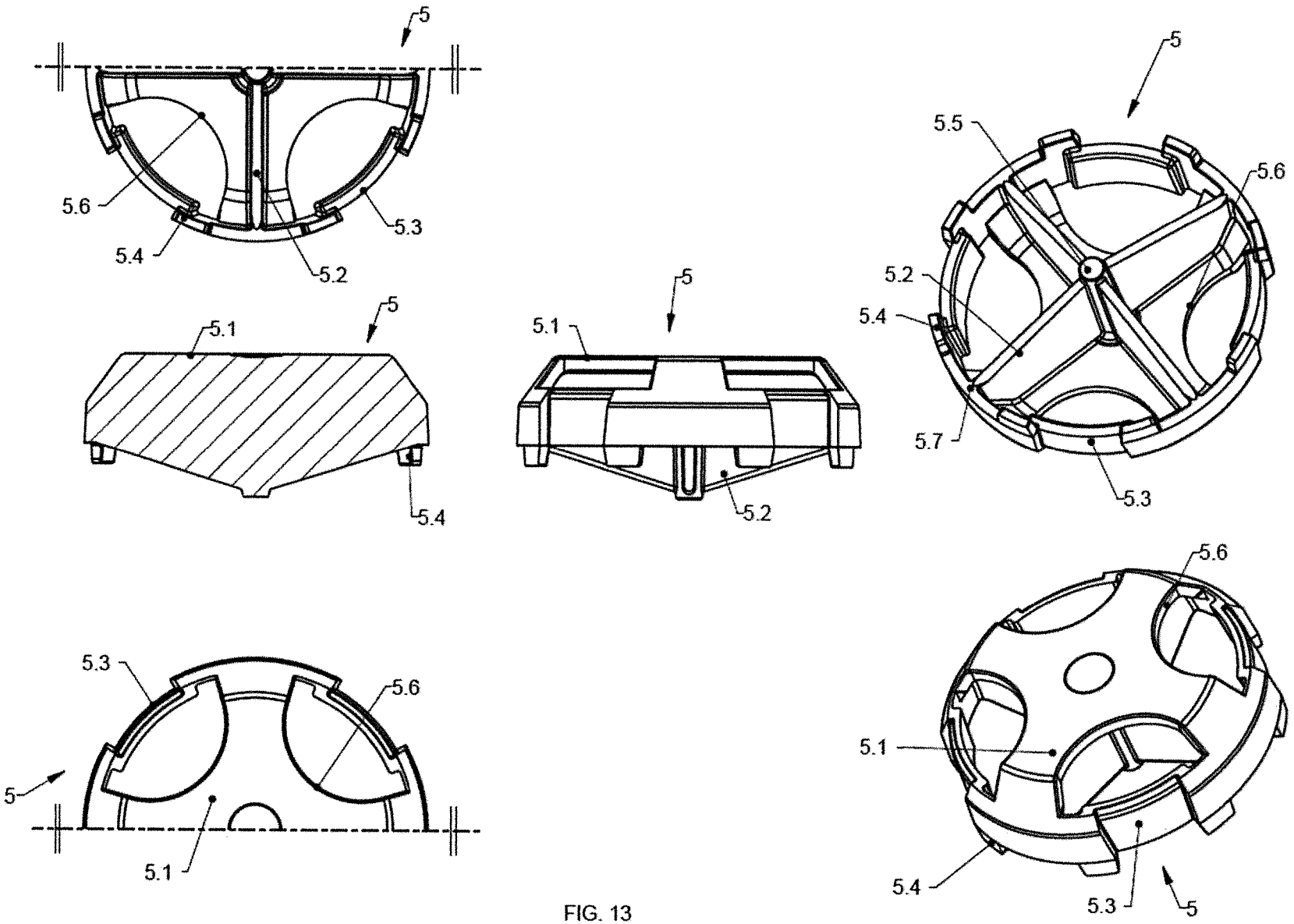
FIG. 13 is a view of the abutment plate of the tap of the invention in different positions and with different details.
Figure 14:
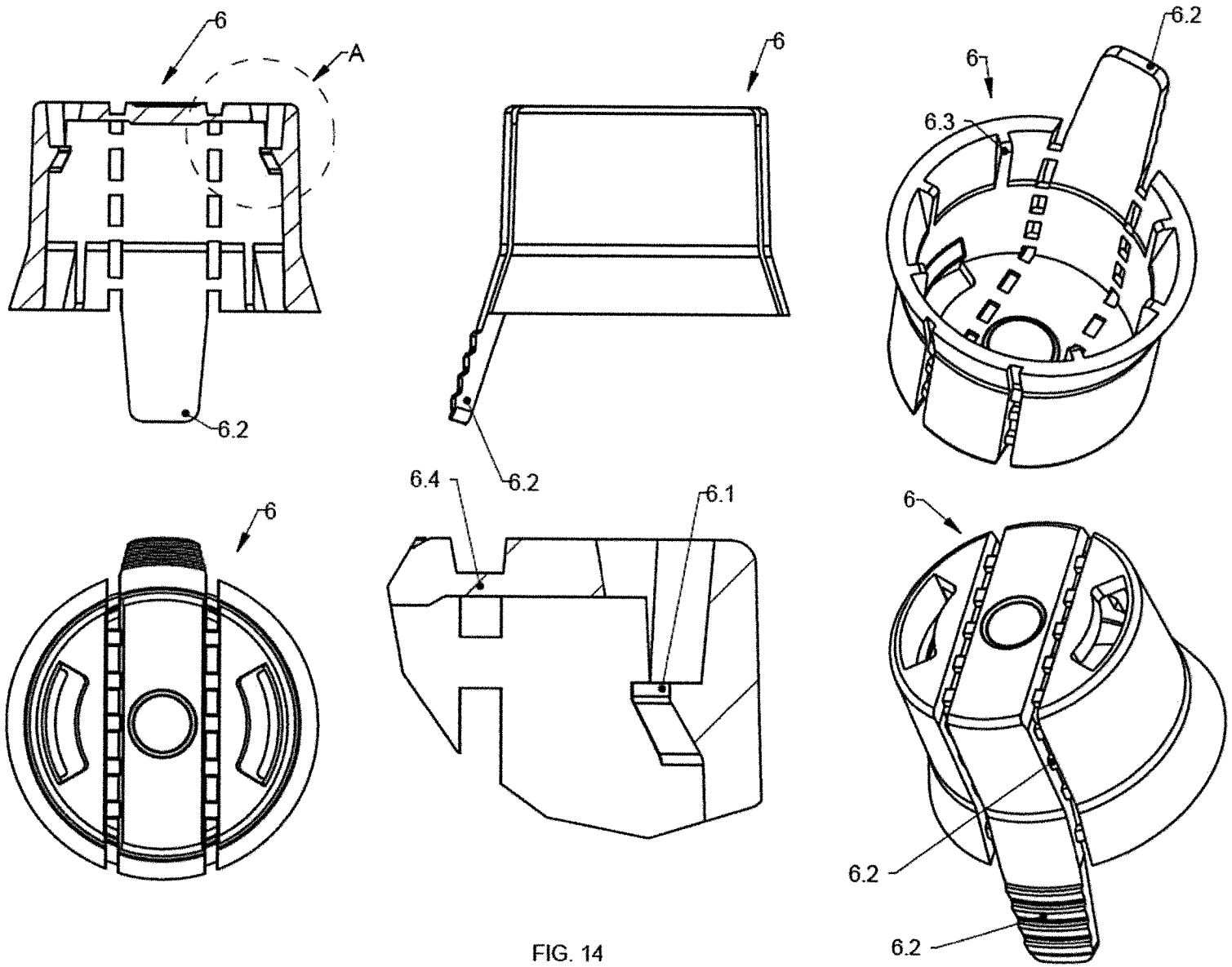
FIG. 14 is a series of views of the seal of the tap of the invention in different positions and with different details.
Figure 15:
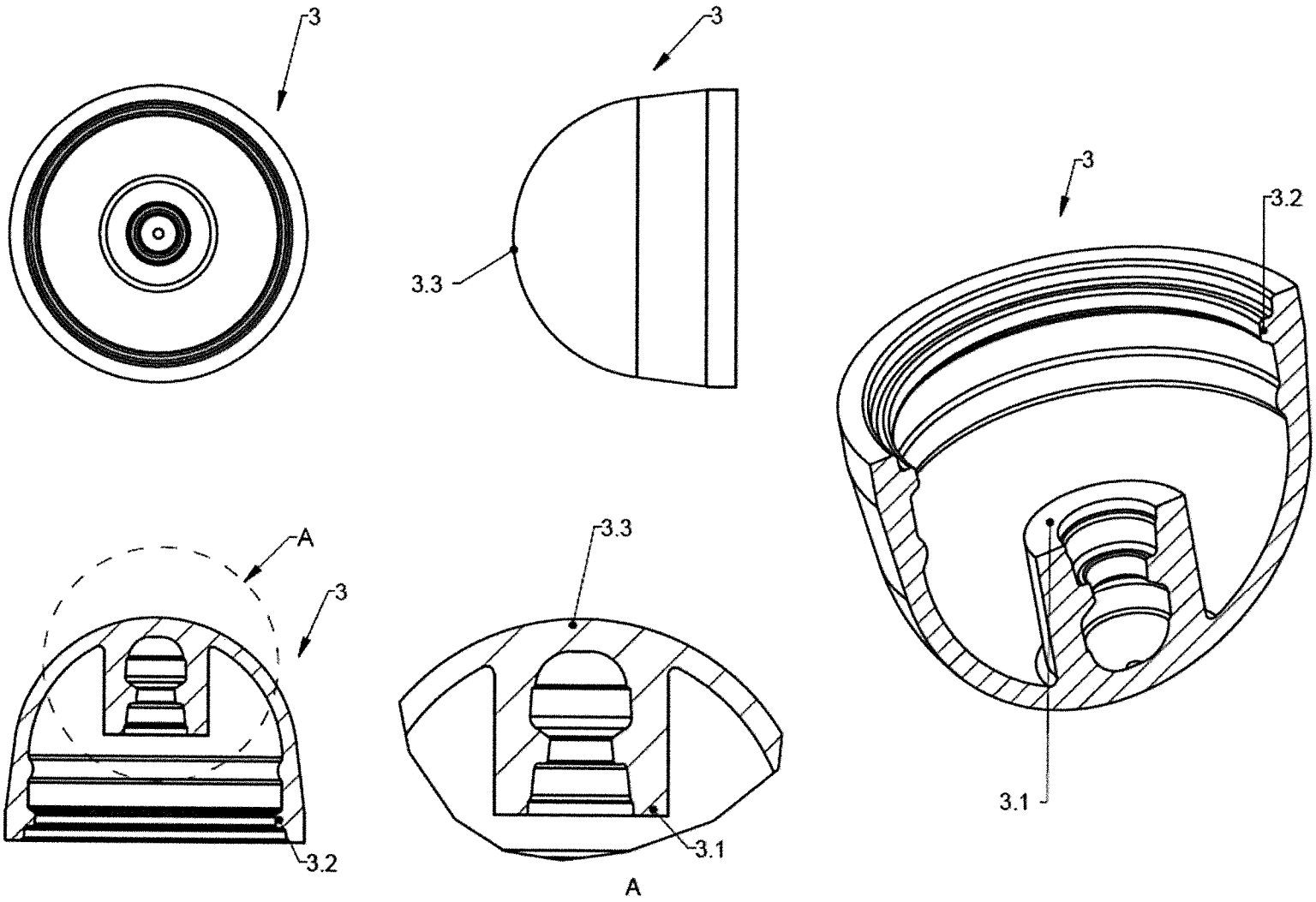
FIG. 15 is a series of views of the internal dome-shaped valve produced with a special thermoplastic elastomer.

On the opposite end 0B to the above described liquid delivering geometry 0A shown in FIG. 11, there are sealing rings 2.7 which are adapted to be operatively connected to the connecting mouth (not shown) which in turn is welded to the bag of the BIB and operates as connecting element between the tap and the BIB bag.

Figure 3:
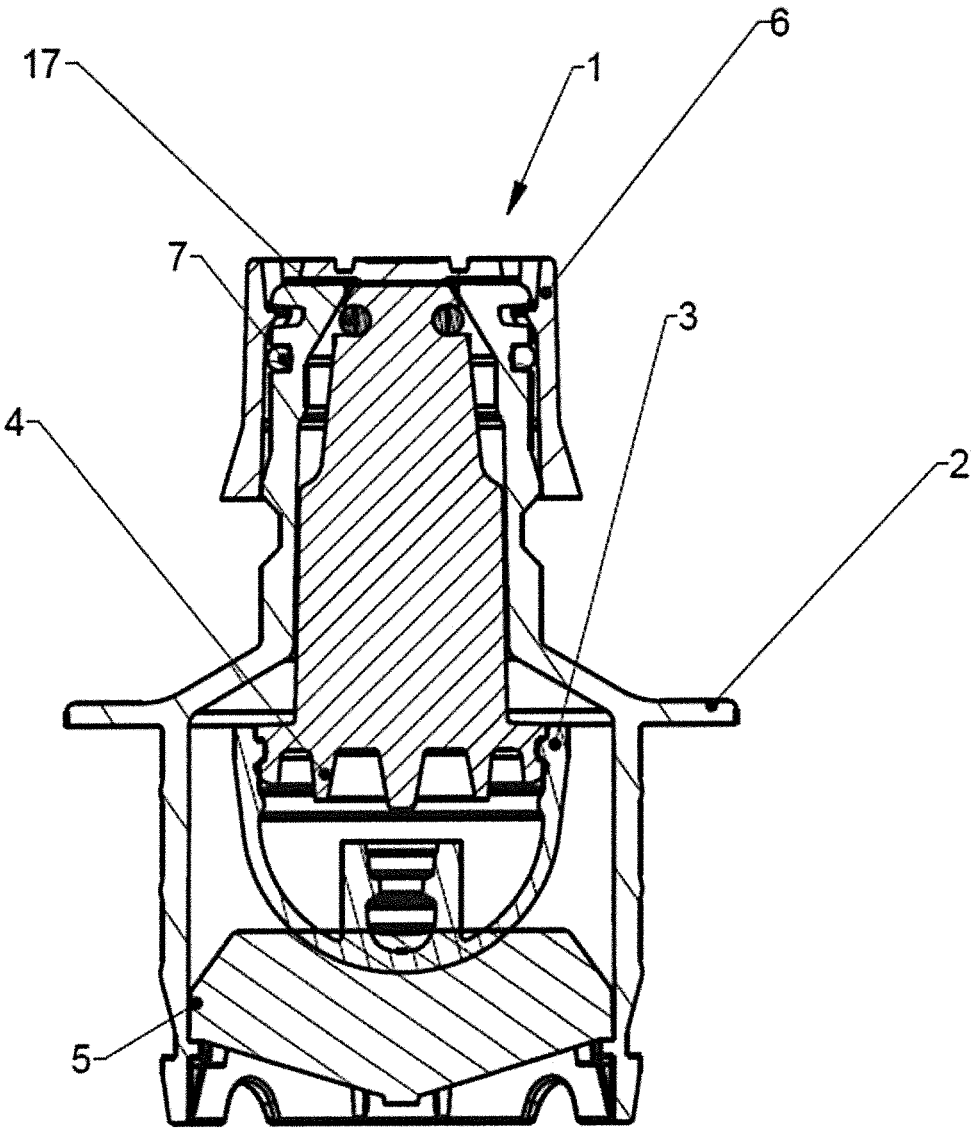
FIG. 3 is a sectional view of the assembled tap of FIG. 1.
Figure 4:
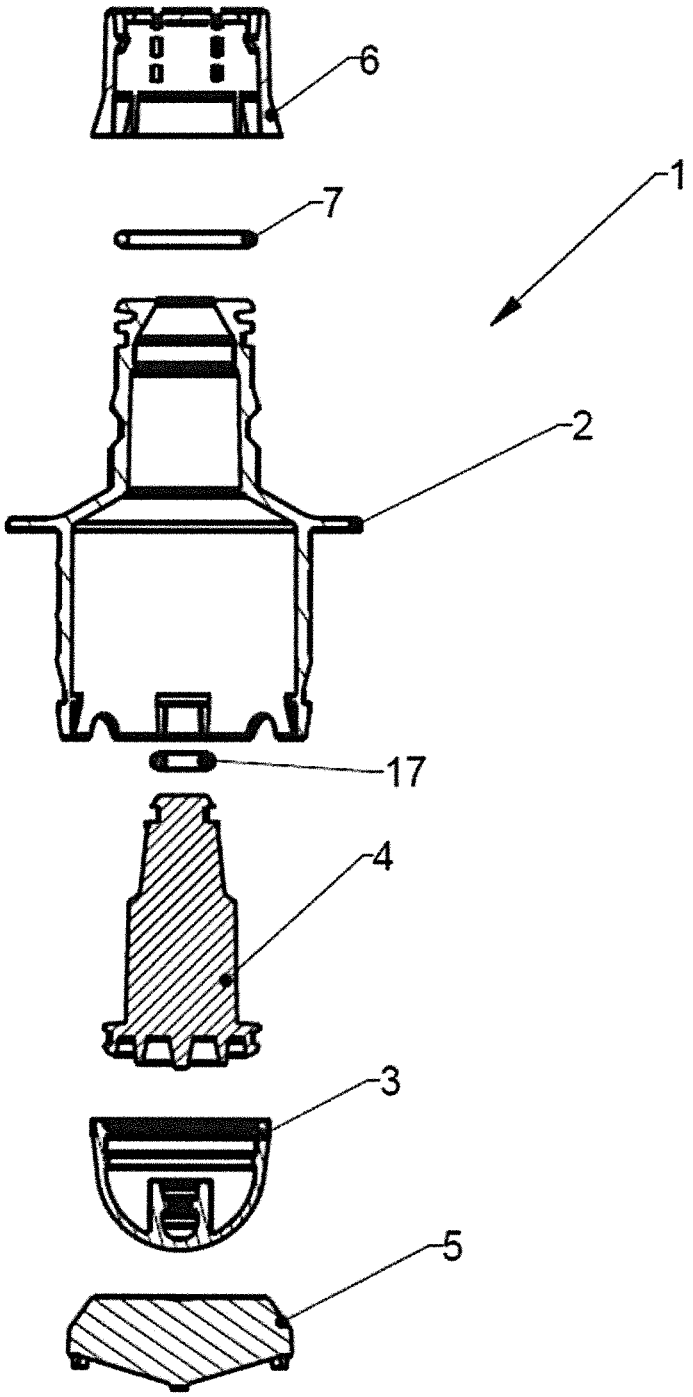
FIG. 4 is an exploded sectional view of the tap of the invention of FIG. 1.
Figure 5:
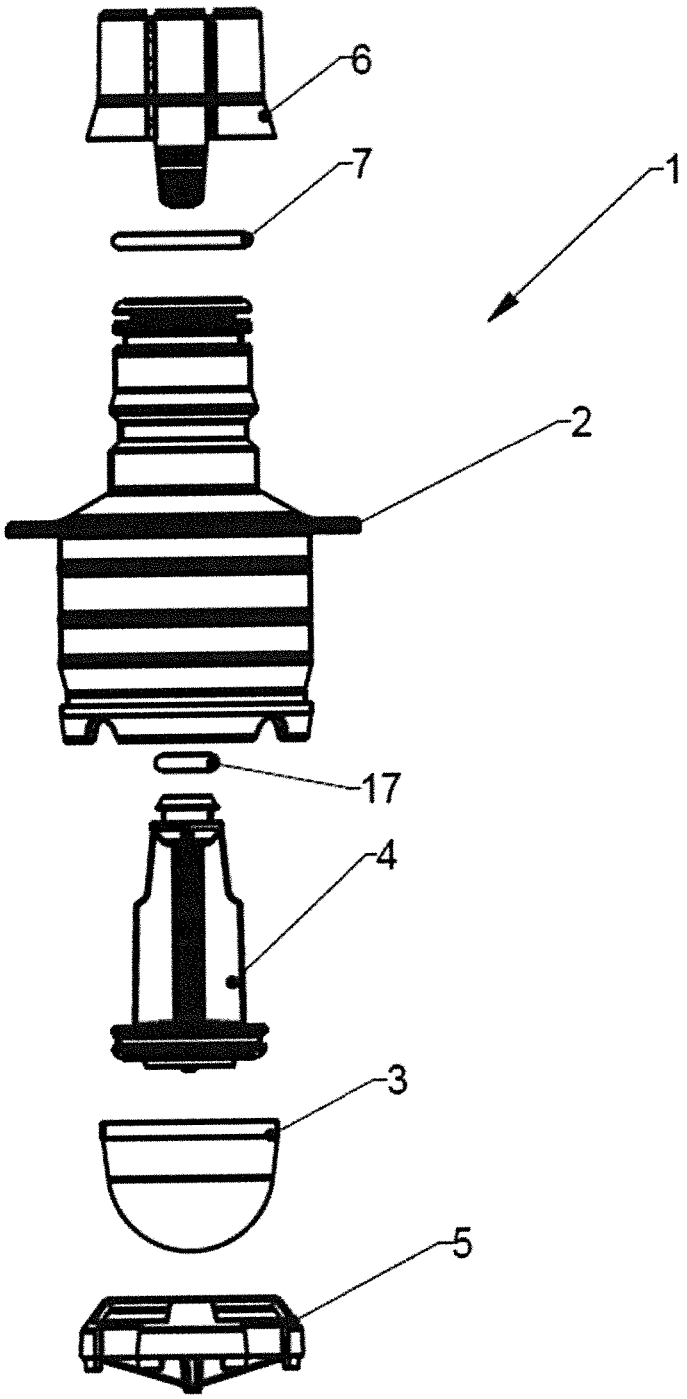
FIG. 5 is an exploded view of the tap of the invention of FIG. 1.
Figure 6:
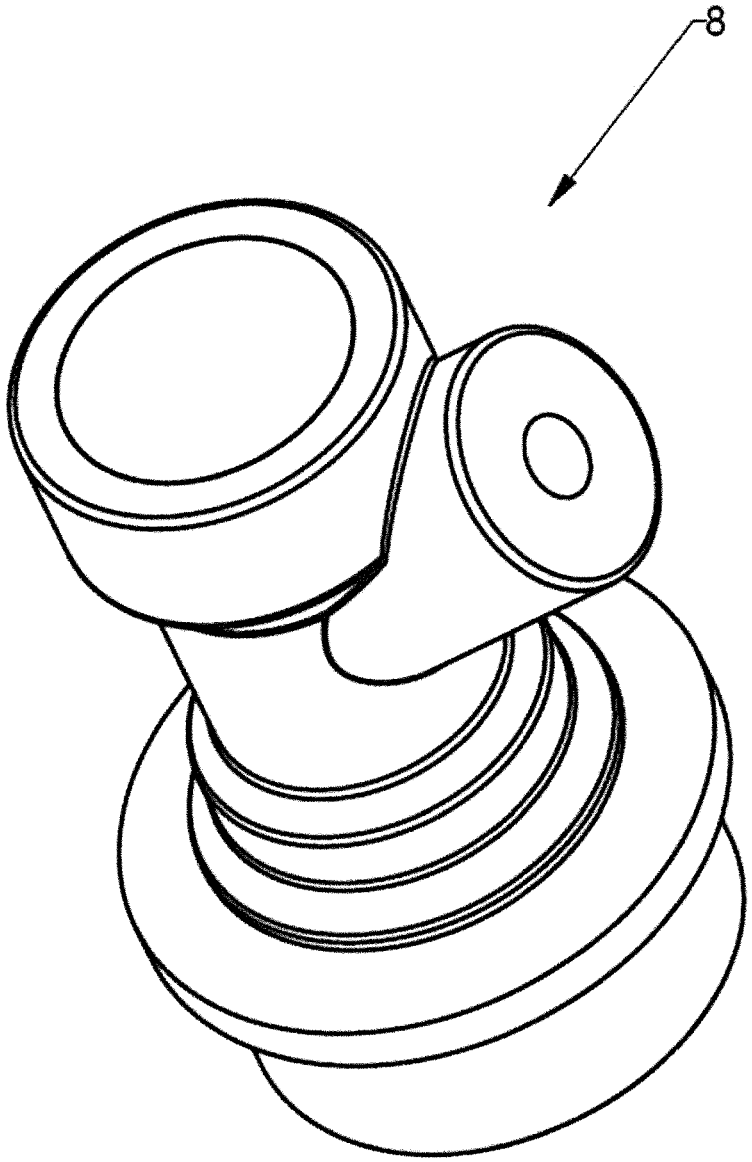
FIG. 6 is a perspective view of a connector present on the market.
Figure 7:
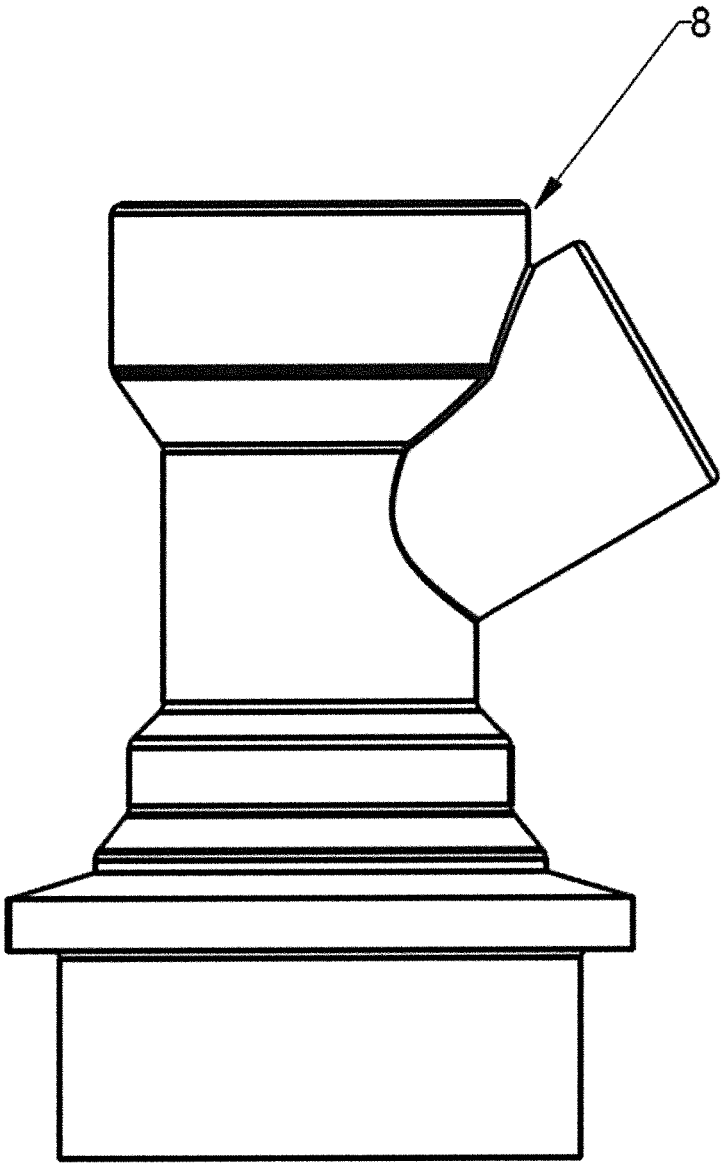
FIG. 7 is a side view of a connector present on the market.

There is a ring 2.6 with sharp edge (area 0B) which operates as abutment for preventing the removal of the tap 1 once inserted in the connecting mouth. There is also, inside the front cylindrical geometry 2.9 (area 0A) inside of the body 2, a chute 2.1 which operates as guide/seat/abutment of the internal sealing O-ring 17 assembled on a central pin 4 in its seat 4.5, and it performs an operative seal, as shown in FIG. 3.

There are, inside the rear part of the body 2 (area 0B in FIG. 11), four special internal geometries 2.5, preferably of the wedge-type, to enable the entry of the plate 5, adapted to support/allow the abutment fastening of the plate 5. Such geometries 2.5, obtained by means of successive movements of plates and males, allow constraining the plate 5 to the body 2 stably and mechanically in an unmovable and safe manner, as shown in FIG. 3, and they operate as abutment onto a dome-shaped valve/spring 3 made of elastomeric material, which in turn is stably assembled, and guides the central pin 4 by means of the fastening geometries 4.3 present on the central pin 4 and of the geometries 3.2 present on the dome-shaped valve/spring 3 made of elastomeric material.

Externally, there is a complete disk 2.11.

Outside the elongated body 2, there are fastening geometries 2.2 useful for fastening the tamper-preventing seal 6 and the seat 2.3 of the external sealing O-ring 7.

Further, in the rear area of the tap (area 0B in FIG. 11), there are rounded discharge areas 2.4, which are used to better and completely empty the BIB vessel, avoiding that, during the last emptying step, the film performs a sucking effect (normally the vessels which contain concentrated liquids, in order to enable the emptying, use a pump, preferably a peristaltic pump, which increases the chance of a suction effect of the film on the tap at the end of the vessel life, in turn almost emptied) on the remaining tap 1, avoiding the final emptying. Such geometries 2.4 enable the complete emptying of the BIB bag.

The tap 1 of the invention further comprises the central pin 4 having an elongated shape and equipped with fastening geometries 4.3 of the elastic dome 3 on one end, and, on the opposite end, with a geometry 4.5 which is the seat of the O-ring 17, which performs an operating seal on the internal chute 2.1 of the body 2.

Moreover, there are four stiffening geometries 4.4 of the pin 4, which also operate as guide to have an axial sliding of the pin 4 inside the body 2, when it will be activated by the connector 8 in an opening thrust.

On the lower part, under the fastening geometry of the dome 3, there is an abutment plane 4.1 which generates an opening of the connector 8 during its operating step, once this is operatively connected to the tap 1 of the invention.

There is also a central driving pin 4.2.

Further, the tap 1 is equipped with an elastic valve/spring 3, preferably shaped as a dome, which is operatively connected to the central pin 4 by means of the geometry 4.3 with the elastic valve geometry 3.2.

In turn, the valve 3 rests on and has as operating abutment, the plate 5, by means of the plane geometry 5.1, as shown in FIG. 3. The dome-shaped elastic valve 3 allows automatically closing the tap 1 of the invention.

The tap 1 further comprises a read abutment element (or plate) 5 which, once stably connected onto the body 2 by means of a fastening of the bayonet type, is inserted by exploiting the "recesses" 5.3 and making them pass next to the small teeth 2.5 of the body 2 and, through a rotation of the bayonet fastening type, sending them to engage, or better stably abut, in the abutment seats 5.7 present on the plate 5. Once having engaged/assembled the plate 5 on the body 2, this latter one pushes onto the elastic dome 3.3 due to a plane 5.1 which, in turn, being stably assembled on the central pin 4 by means of the geometry 4.3, pushes the O-ring 17 assembled on the central pin 4 in the seat 4.5 in operating seal on the internal chute 2.1 of the body tap 2.

The plate 5 is equipped with through recesses 5.6, useful to allow the passage of liquid when the tap 1 is in its opening position, and with stiffening ribs 5.2 of the plate 5, useful to provide a structure to the plate 5 itself.

There are also a central peg 5.5, useful as centring when assembling the tap 1, and small blocking teeth 5.4 useful to block the plate 5 onto the small teeth of the body 2 (2.5) and to avoid its rotation.

The tap 1 further comprises at least one upper closing element (or tamper-preventing seal) 6, which goes in operating coupling with the body 2 due to the geometries 6.1 present on the tamper-preventing seal 6 and to the seat 2.2 present on the body. Such seal 6 is used for hygienically protecting the tap 1 during all steps preceding the operation connection between tap 1 and connector/the 8. It further provides evidence of opening/tampering, due to its tearable band 6.2, which, once broken/torn, due to the guided breakage bridges 6.4, is impossible to be restored and provides evidence of breaking to clients/users, safeguarding product and users themselves.

There are also centring guides 6.3 on the body 2 to enable its assembling.

Sometimes, for particular needs, the tamper-preventing seal 6 can be replaced by an aluminium operculum (not shown), which has the same function of the above described seal (opening evidence, product protection), since it is welded onto the body 2 and then, once removed, it is impossible to place it back again, thereby providing evidence of its opening, in addition to protection, for the tap 1.

Figure 10:
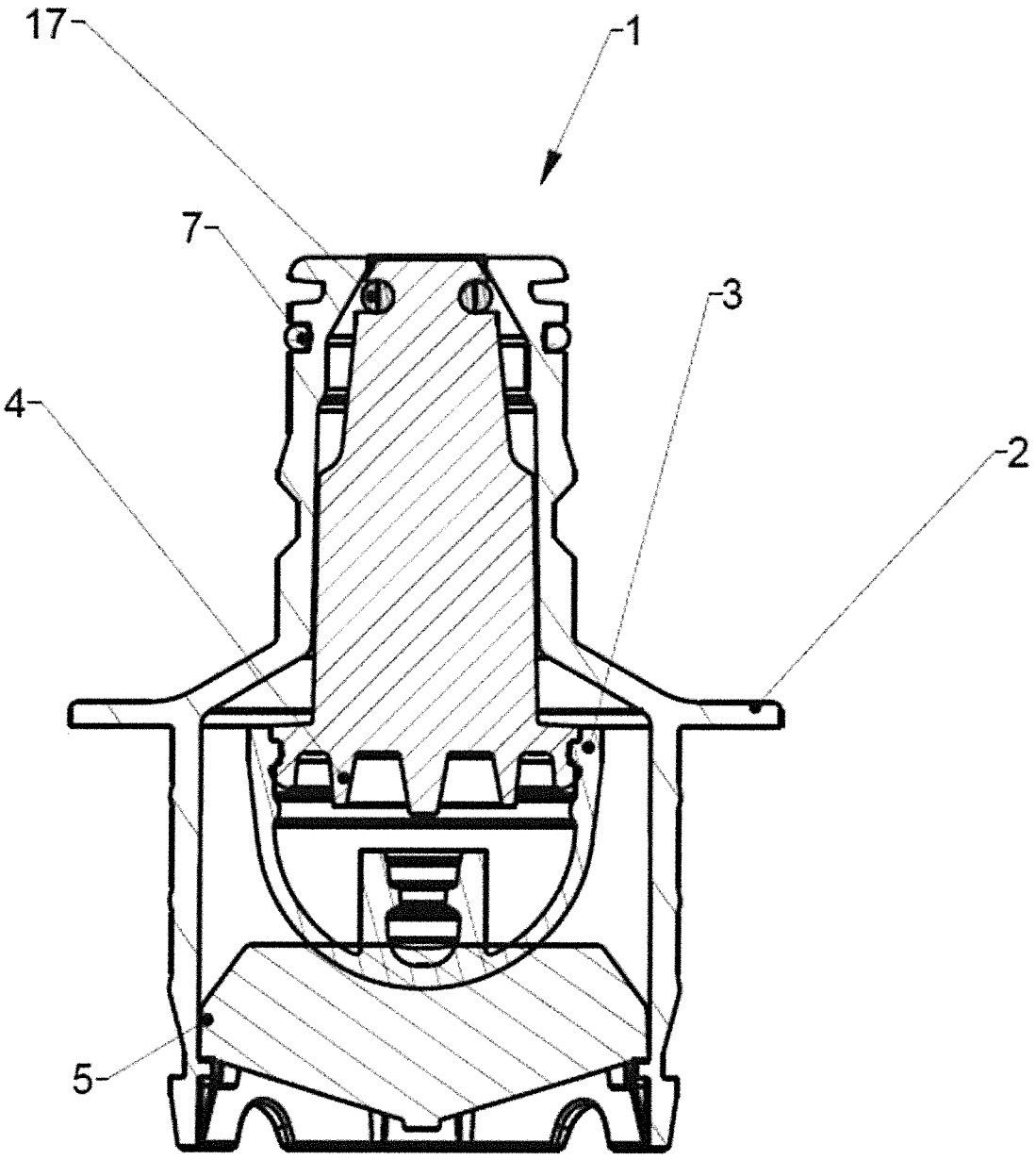
FIG. 10 is a sectional view of the tap of the invention once having disconnected the connector in its closing position.

In particular, with reference to FIG. 10, where the tap 1 of the invention is shown in section, but in its closing position, it can be noted that, in the main element or body 2, the central pin 4 is inserted, on which the toroidal sealing O-ring 17 is assembled in its suitable seat 4.5.

The two assembled elements (pin 4 and O-ring 17) are assembled on the dome-shaped elastic element 3, whose purpose is pushing and perfectly matching in operating seal the O-ring 17 on the internal chute 2.1 of the body 2.

The peg of the coupling O-ring 17+pin 4+dome-shaped elastic element 3 is given by the plate 5, once assembled in its operating position and blocked due to the elements 2.6 obtained on the body 2 and the elements 5.7 obtained on the plate 5.

The elastic dome-shaped element 3 rests on the plane surface 5.1 of the plate 5 and pushes with the correct force the assembly composed of pin 4+O-ring 17 against the chute 2.1 of the body 2, performing the operating seal with tap closed.

Figure 9:
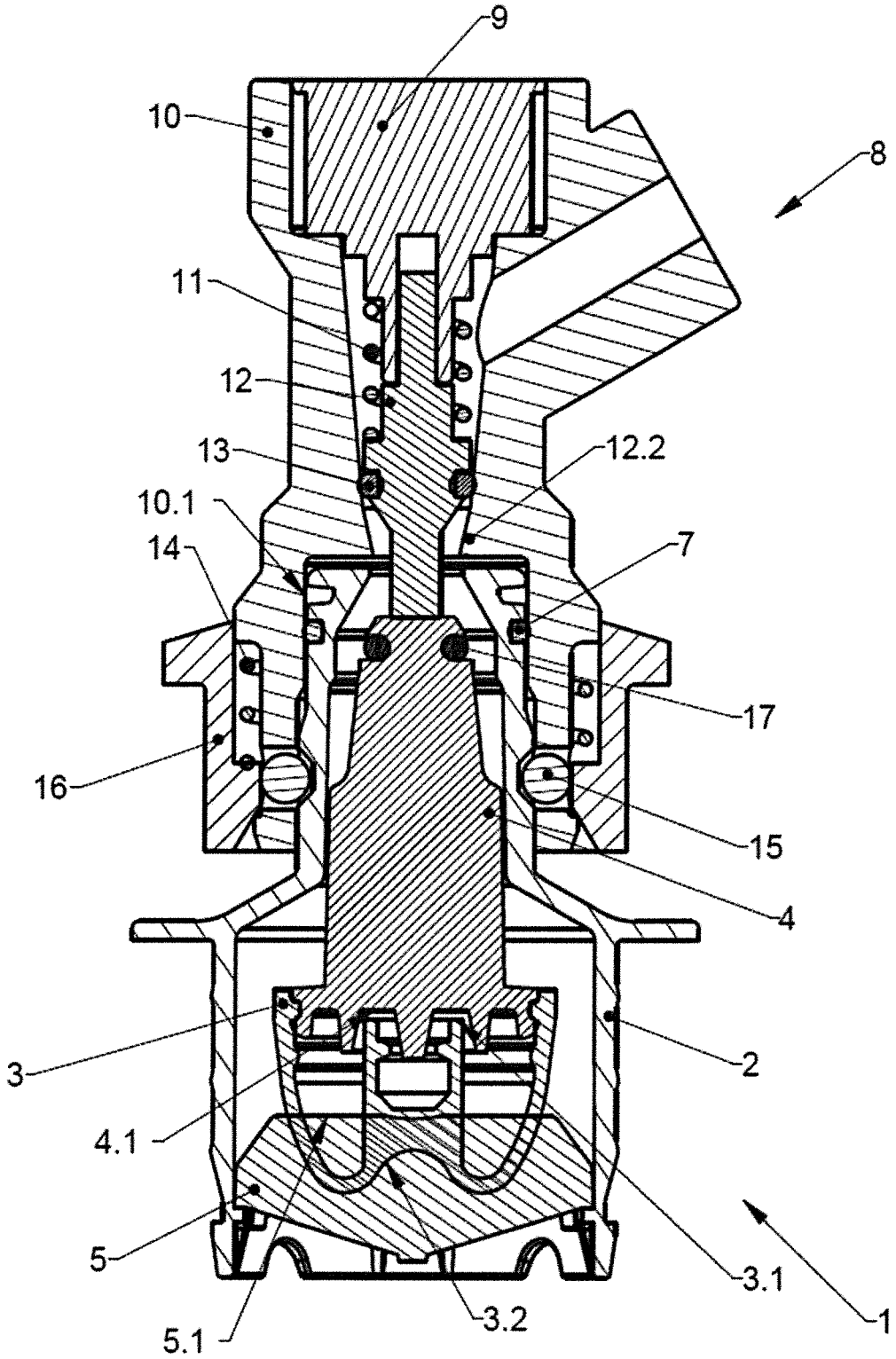
FIG. 9 is a side sectional view of the tap of the invention connected and in an operating position with the connector.

With reference to FIG. 9, it can be seen that the connecting by means of the quick fastening (in this case with balls 15) of the CMB connector 8 or the like present both on the tap 1 (which obviously has the necessary external geometries to obtain and be regularly coupled with the connector 8 due to the geometries 2.9), and on the connector 8. By descending during the screwing step, the connector 8 operatively seals the tap 1 due to the external wall 10.1 of the connector 8. Simultaneously, the element 12 pushes onto the pin 4 and in particular onto the surface 4.6 of the pin 4 of the tap 1, making it open.

When the descent of the assembly pin 4+O-ring 17+dome-shape elastic valve 3 ends its operating stroke and the central pin 4, due to its plane geometry 4.1, collides with the inside of the dome-shaped valve 3 in its plane 3.1, this latter one is blocked and simultaneously starts opening the connector 8, grazie to the movement of the internal pin 12 of the connector 8 on which a sealing O-ring 13 is assembled, which, when the connector 8 is in its closing step, performs an operating seal on the internal chute 12.2.

In this step, once having ended the complete operating descent of the connector 8 onto the tap 1, an open channel is created, which allows the continuous delivery of the product contained in the vessel (in this case a BIB).

The flexible valve 3 is connected to the central pin by means of the geometries 4.3 and 3.2, thereby making the dome-shaped elastic element 3 generate from this coupling (and from the thrust on the plate 5 on the plane 5.1) the necessary force to automatically close again the assembly of the tap 1, once having removed the connector 8.

Obviously, it is possible, by changing the geometries of the various pieces, to create variations of the tap 1 of the invention, which always fall within the scope of the enclosed claims.

With the tap 1 of the invention, the problem of the metallic spring (not present any more) has been solved. The tap 1, being completely made of plastic, is recyclable and ecologically acceptable.

With reference to FIG. 10, it can be noted that the automatic handling and return members 5 and 3 occupy the majority of the space of the rear part of the tap 1. This arrangement offers less space for air and consequently such space decrease for air present on the back of the tap 1 (which is the one which will contact the liquid when the tap 1 is connected to the mouth) will coincide with less air inserted in the bag after filling it, and lower risk of oxidation with respect to the prior art tap arrangement, where the rear free space is occupied only by a metallic spring, but the remaining volume is occupied by air which enters in the bag and oxidizes the liquid contained therein.

The invention claimed is:

1. A tap for delivering liquids from a vessel, the tap comprising:

an elongated supporting body equipped with an inclined internal contact surface next to its delivery end;

an upper closing element and tamper-preventing seal which closes the delivery end of the supporting body;

a dome-shaped elastic valve element at an opposite end with respect to the delivery end of the supporting body, the dome-shaped elastic valve element performing an automatic closure of the tap; and a plate operatively connected to the dome-shaped elastic valve element;

a pin centrally placed inside the supporting body and equipped with an O-ring adapted to sealingly engage the inclined internal contact surface when the tap is closed, the dome-shaped elastic valve element being operatively connected to the pin;

wherein the dome-shaped elastic valve element rests on the plate and pushes pin and O-ring against the inclined internal surface of the supporting body, performing an operating seal with the tap closed, and wherein, when an assembly of pin O-ring dome-shape elastic valve ends its operating stroke and the pin collides with an interior of the dome-shaped elastic valve element, the dome-shaped elastic valve element is blocked and simultaneously allows entering into the elongated supporting body liquid to be delivered, creating an open channel which allows the continuous delivery of the product contained in the vessel.

2. The tap of claim 1, wherein the supporting body is equipped, at the delivery end, with coupling and liquid-sealing means, and, at its opposite end, with means for connecting and sealing to a mouth of the vessel and for preventing the removal from the vessel, the supporting body being further equipped, at its delivery end, with a cylindrical extension, on which fitting geometries for the vessel are obtained.

3. The tap of claim 1, wherein the supporting body is further equipped, at its end, with: sealing rings adapted to be operatively connected to a connecting mouth, in turn welded to a vessel, which operates as connecting element between the tap and the vessel bag; a ring with sharp edge which operates as removal preventing abutment of the tap once inserted in the connecting mouth; four wedge-shaped internal geometries to enable an entry of the plate, adapted to support/allow an abutment fastening of the plate, the wedge-shaped internal geometries also operating as abutment onto the dome-shaped valve.

4. The tap of claim 1, wherein, outside the elongated body, there are fastening geometries of the tamper-preventing seal and a seat for an external sealing O-ring, at the end of the supporting body being further present rounded discharge areas, which operate in order to better empty the vessel.

5. The tap of claim 1, wherein the central pin is equipped with fastening geometries of the dome-shaped elastic valve on an end and, on an opposite end, with a geometry which is the seat of the O-ring which performs an operating seal on the internal chute of the supporting body, the central pin further comprising four stiffening geometries, which also operate as guide to perform an axial sliding of the pin inside the supporting body, when it is activated in opening thrust for delivering liquid, the central pin further comprising, on its lower part, under the fastening geometry of the dome, an abutment plane which performs an opening of the delivery duct of the liquid, and a central driving pin.

6. The tap of claim 1, wherein the plate, once stably placed on the supporting body by means of a fastening of the bayonet type, is inserted by exploiting recesses and making them pass next to small teeth of the body and, through a rotation of the bayonet fastening type, sending them in stable abutment in the abutment seats of the plate, once having engaged/assembled the plate on the body, the plate pushing on an elastic dome of the dome-shaped valve due to a plane which in turn, being stably assembled on the central pin by means of geometry, pushes the O-ring assembled on the central pin in the seat in an operating seal on the internal chute of the supporting body.

7. The tap of claim 6, wherein the plate is further equipped with through recesses, useful to allow the passage of liquid when the tap is in its opening position, with stiffening ribs of the plate, and with a central peg operating as centring when assembling the tap.

8. The tap of claim 1, wherein the upper closing element or tamper-preventing seal goes into an operating coupling with the supporting body due to the geometries present on the tamper-preventing seal and to the seat present on the body, the tamper-preventing seal being equipped with a tearable band, which, once being broken/torn due to the guided breakage bridges, is impossible to restore and provides evidence of its breakage to clients/users, the seal being also preferably equipped with centring guides on the body to enable its assembling.

9. The tap of claim 8, characterized in that wherein the tamper-preventing seal is replaced by an operculum having the same function of opening evidence and liquid protection with respect to the seal, since it is welded onto the body and therefore, once removed, is impossible to be placed back again.

* * * * *